United States Patent [19]

Sanders et al.

[11] 3,952,903

[45] Apr. 27, 1976

[54] CLOSED CONTAINER

[75] Inventors: Ellsworth E. Sanders, Sanibel Island, Fla.; Elsmer W. Kreeger, Bloomfield, Mich.

[73] Assignee: Pinckney Molded Plastics, Inc., Pinckney, Mich.

[22] Filed: Oct. 21, 1974

[21] Appl. No.: 516,460

[52] U.S. Cl. ..... 220/4 E; 206/505; 206/519; 220/94 A

[51] Int. Cl.[2] ..... B65D 21/02; B65D 11/10

[58] Field of Search ..... 220/4 B, 4 E, 94 A; 206/505, 507, 519, 520, 518

[56] References Cited

UNITED STATES PATENTS

| | | | |
|---|---|---|---|
| 3,145,870 | 8/1964 | Lockwood | 220/4 E |
| 3,754,646 | 8/1973 | Henig | 220/4 E |
| 3,831,805 | 8/1974 | Yonce | 220/94 A |

FOREIGN PATENTS OR APPLICATIONS

| | | | |
|---|---|---|---|
| 1,486,241 | 5/1969 | Germany | 220/4 E |

*Primary Examiner*—George E. Lowrance
*Attorney, Agent, or Firm*—Whittemore, Hulbert & Belknap

[57] ABSTRACT

A closed container composed of identical separable parts each of one-piece plastic construction. Each part has a rectangular base, an upright rear wall, and upright side walls cut diagonally or on the bias. The top and front of each part is substantially open so that it may be used independently of the other part for display purposes. When one of the parts is turned end for end, superposed over the other part and lowered relative thereto, snap-type connectors engage to hold the two parts in assembled relation to form the closed container.

11 Claims, 10 Drawing Figures

FIG. 3
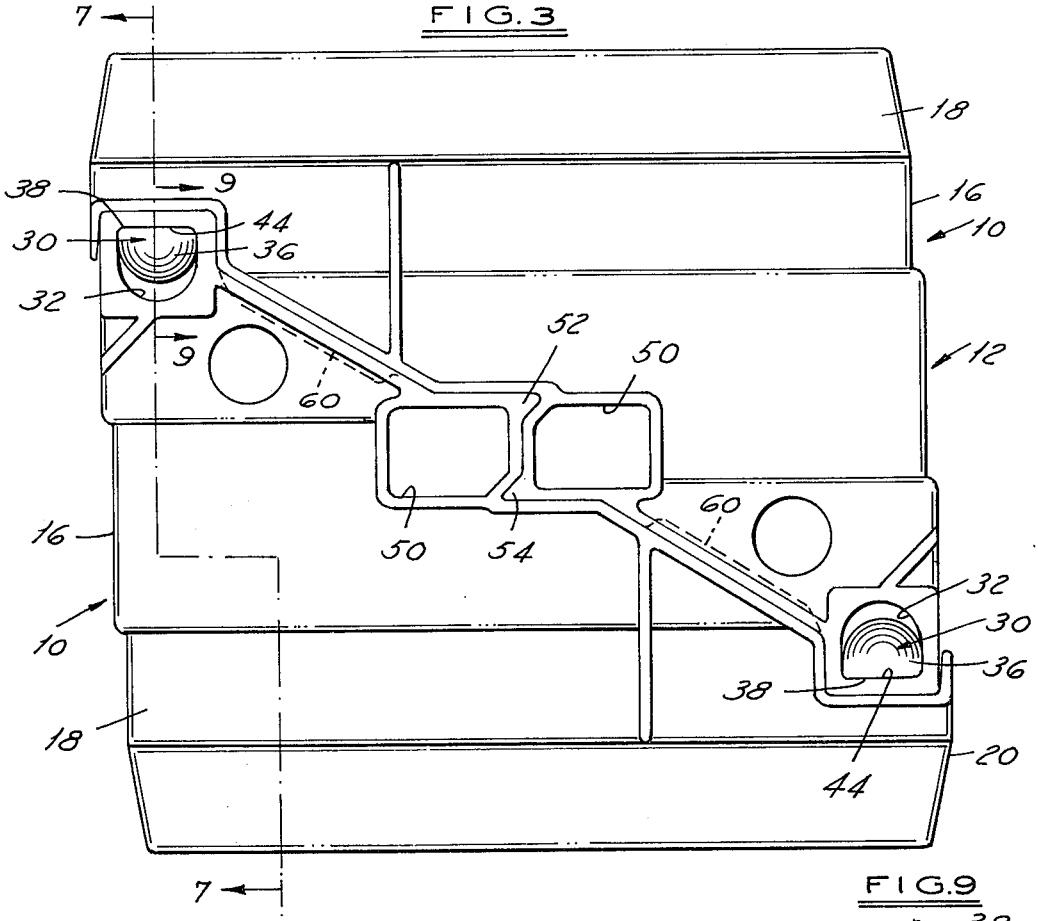
FIG. 9
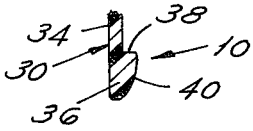
FIG. 2
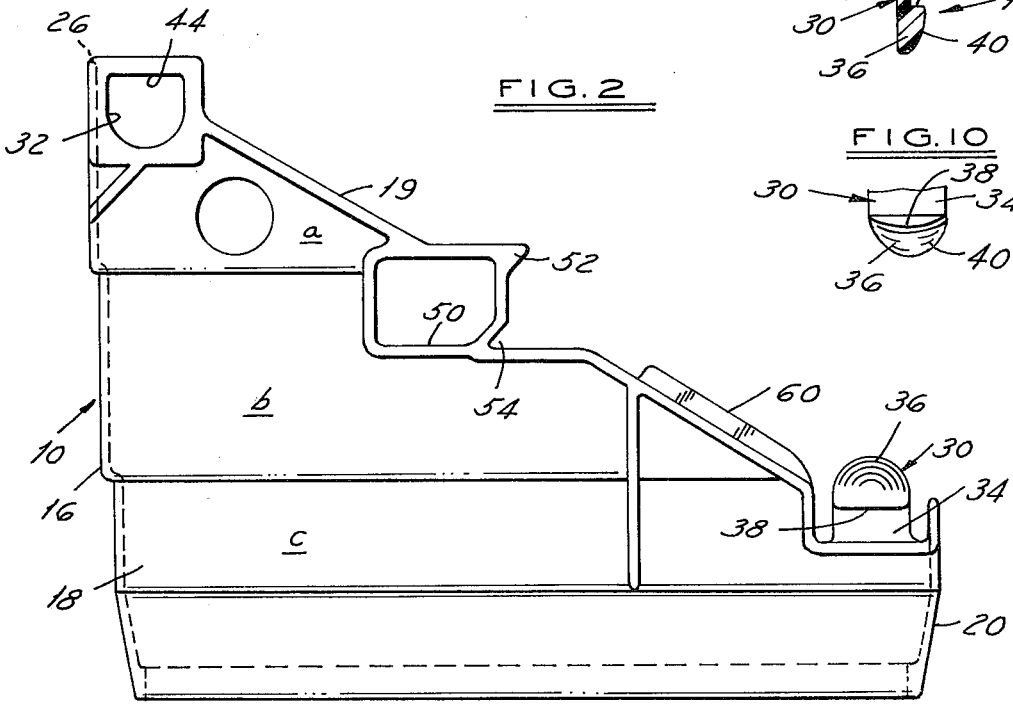
FIG. 10

CLOSED CONTAINER

SUMMARY OF THE INVENTION

A general object of this invention is to provide a substantially closed container composed of identical separable parts which are also adapted for use independently of one another for display purposes.

Other objects and features of the invention include the provision of novel snap connectors for joining the two parts of the container together. The connectors are adapted to snap into locking relation with one another when the two parts of the container are moved into assembled relation.

In accordance with a specific embodiment of the invention about to be described, the snap connectors for locking the two parts of the container together comprise a member on one part having an enlarged head and a socket on the other part having a recess adapted to receive the head. Preferably the head has a shoulder which engages over an edge of the recess for releasably holding the parts together, and the head is tapered so as to have a camming action such that the head and associated recess automatically snap together when the two parts are moved into assembled relation.

Additional features of the invention include forming the connectors in such a way that they release when the container parts are pivoted relative to one another, so that the container parts may be readily disassembled.

The container parts are preferably formed with flaring side and end walls so that when similarly oriented they will nest.

In the drawings:

FIG. 2 is a side elevational view of the container part shown in FIG. 1.

FIG. 3 is a side elevational view showing a substantially closed container formed by an assembly of two identical parts of the construction shown in FIGS. 1 and 2.

FIG. 9 is a fragmentary sectional view of one of the cooperating snap connectors for joining two container parts together, taken substantially on the line 9—9 in FIG. 3.

FIG. 10 is a fragmentary view of the snap connector shown in FIG. 9 looking in the direction of the arrow 10.

Figure 1:
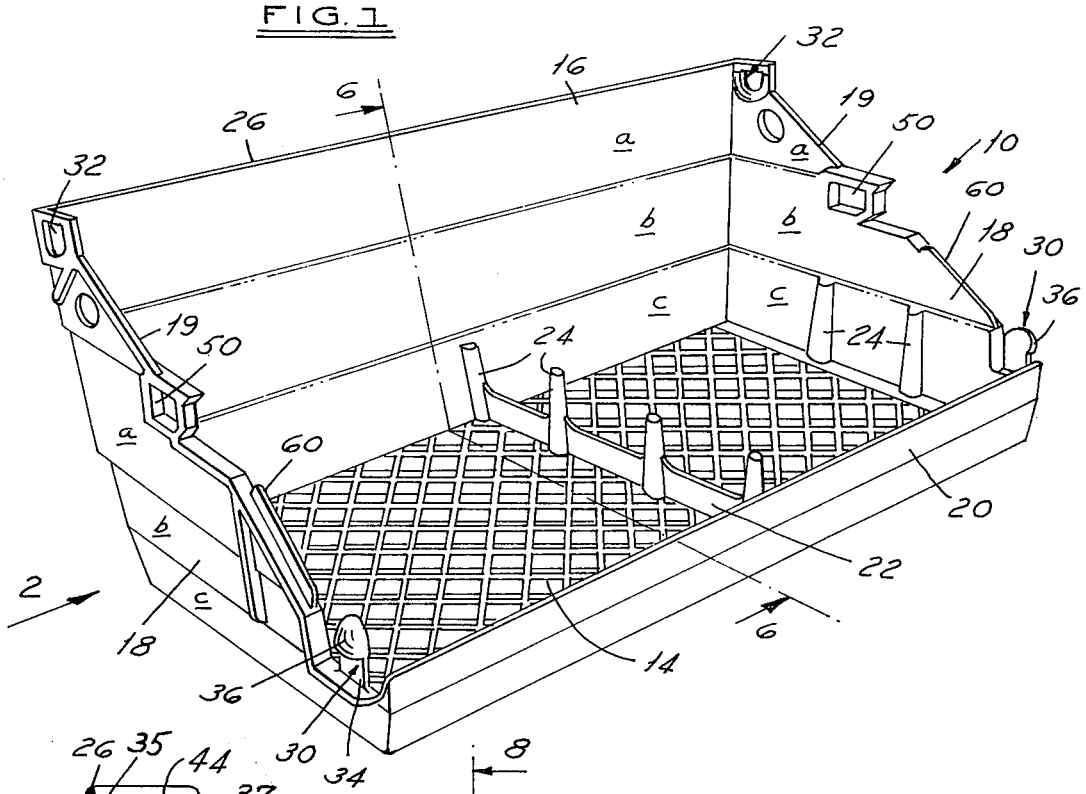
FIG. 1 is a perspective view of one of the container parts, constructed in accordance with our invention.

Referring now more particularly to the drawings, each container part is identified by the reference character 10. The substantially closed container formed by the assembly of two parts 10 is designated 12. The container may be used to carry any desired material although it is particularly designed as a container for egg cartons. The individual container parts 10 are independently useable for display purposes. The container parts may be made of any suitable material, preferably plastic, such for example as molded polyethylene.

Each container part 10 in this instance is of one-piece construction and has a horizontal rectangular bottom wall 14, a rear wall 16, side walls 18 and a low retainer or front wall 20.

The bottom wall in this instance is shown as being of open grid construction. This open grid construction is not necessary to the invention but is desirable for sanitary purposes, making the container easy to clean. A central rib 22 molded to the top surface of the bottom wall 14 midway between the side walls 18 extends from the rear wall 16 to the front wall 20 and has spaced upright pedestals 24 for supporting the base or bottom wall of another container part 10 nested therewith. Additional pedestals 24 along the inner side walls of the container project upwardly from the bottom wall likewise for supporting the base of another container part 10 nested therewith.

The rear wall 16 extends substantially vertically upwardly from the rear edge of the bottom wall and has an upper horizontal edge 26.

The side walls 18 are mirror images of one another. They project substantially vertically upwardly from opposite side edges of the bottom wall. The upper edge 19 of each side wall extends from approximately the upper edge 26 of the rear wall 16 diagonally downward in a forward direction, terminating at the front of the container where it merges into an end of the front retainer or wall 20. The container part 10 is seen to be open at the top and substantially open at the front. The sides are also partially open by reason of the substantially diagonal line of the upper side edges 19. Accordingly, a single container part may be used independently of the other container part for display purposes. The front wall 20 is cut low to serve as a retainer for the articles being displayed and yet to expose the articles on display as much as possible.

Figure 6:
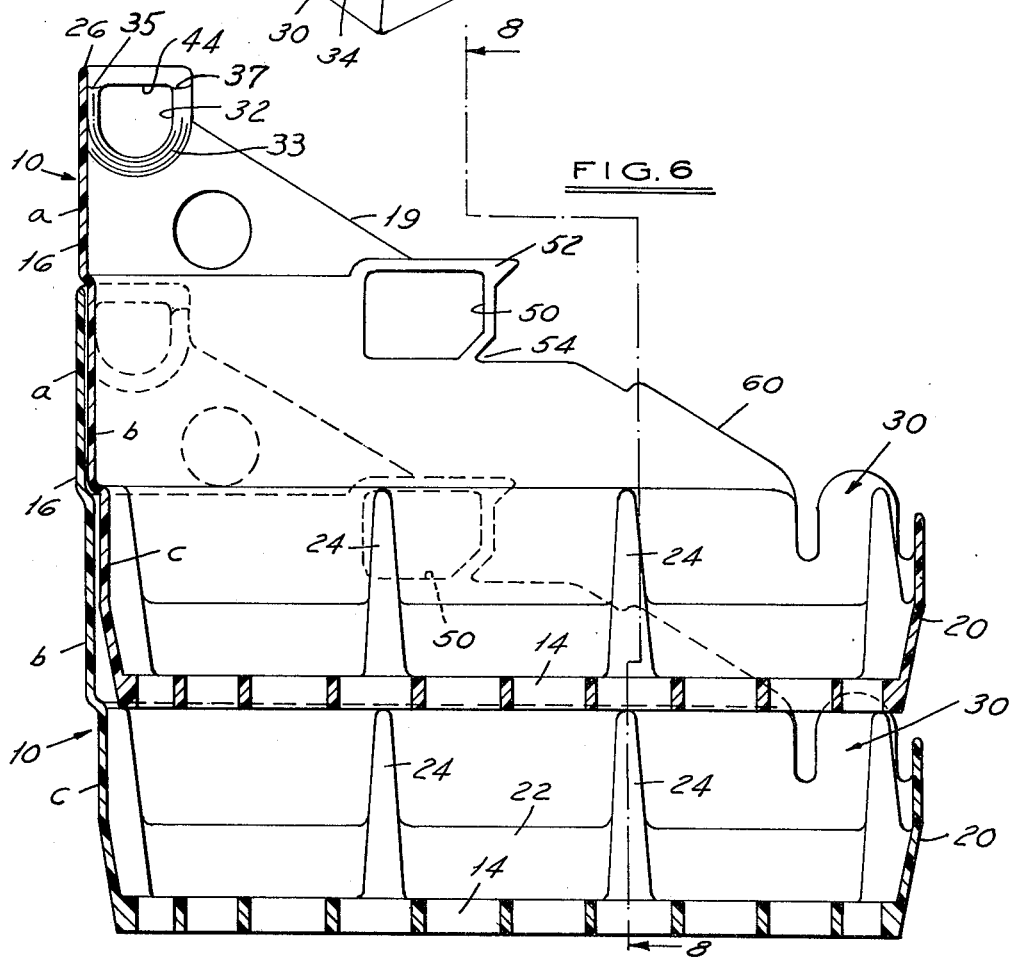
FIG. 6 is a sectional view of two nested container parts, the section being taken on the line 6—6 in FIG. 1.
Figure 5:
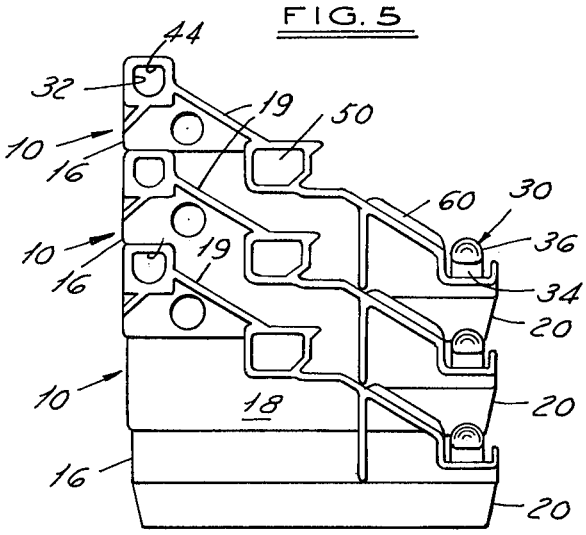
FIG. 5 is a side elevational view on a reduced scale showing a plurality of nested container parts.

The end and side walls 16 and 18 are formed of tiered vertical sections *a*, *b* and *c*. The middle section *b* is stepped outwardly with respect to the lowermost section *c* and the uppermost section *a* is stepped outwardly with respect to the middle section *b*. This stepped tiering configuration of the end and side walls provides an upward flare and permits two identical parts 10 to be nested one within another as clearly shown in FIGS. 5 and 6. The front walls or retainers 20 of two nested container parts 10 do not overlap, as seen in FIG. 6. When nested, the base or bottom wall 14 of the upper container part rests upon and is supported by pedestals 24 of the lower container part. The tiering sections *a*, *b* and *c* are of substantially the same vertical height as seen in FIG. 6.

Each side wall has a male snap connector 30 projecting upwardly from its upper edge near the front of the container part 10 and a complementary female snap connector 32 adjacent its upper edge near the rear of the container. In order to form a closed container from two identical container parts 10, one is turned end for end and superposed over the other and then lowered to cause the snap connector parts 30 and 32 of one side wall respectively to snap into engagement with the snap connector parts 32 and 30 of the other side wall to releasably lock the container parts together in the relationship shown in FIGS. 3 and 7.

The connector part 30 comprises a vertically upwardly extending stem 34 having a head 36 on the upper end. The head 36 at its lower end has a straight shoulder 38 which lies in a horizontal plane on the outer side of the stem. The head has an outer surface 40 which is part-spherical and tapers on a convex arc or curve from the shoulder 38 to the upper extremity of the head. The surface 40 is also convex in horizontal section as seen in FIG. 10 so that the shoulder 38 is of maximum width at the center of the head and gradually feathers out completely at the two sides of the head for the purpose of convenient disassembly as will become more apparent as the description proceeds.

Figure 7:
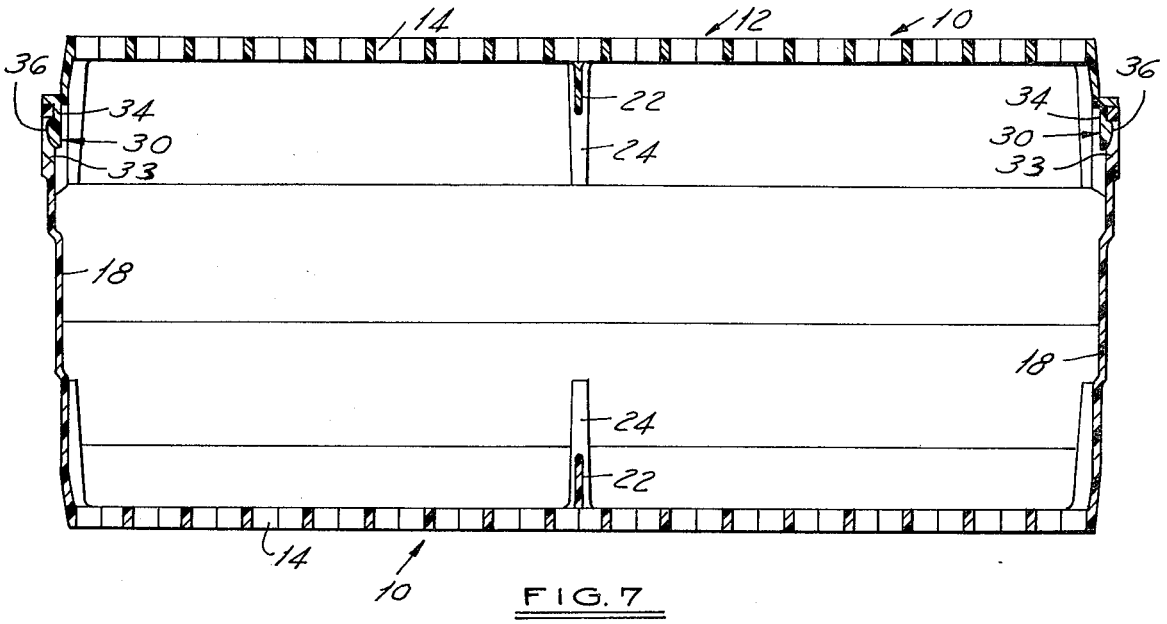
FIG. 7 is a sectional view of the closed container taken on the line 7—7 in FIG. 3.
Figure 8:
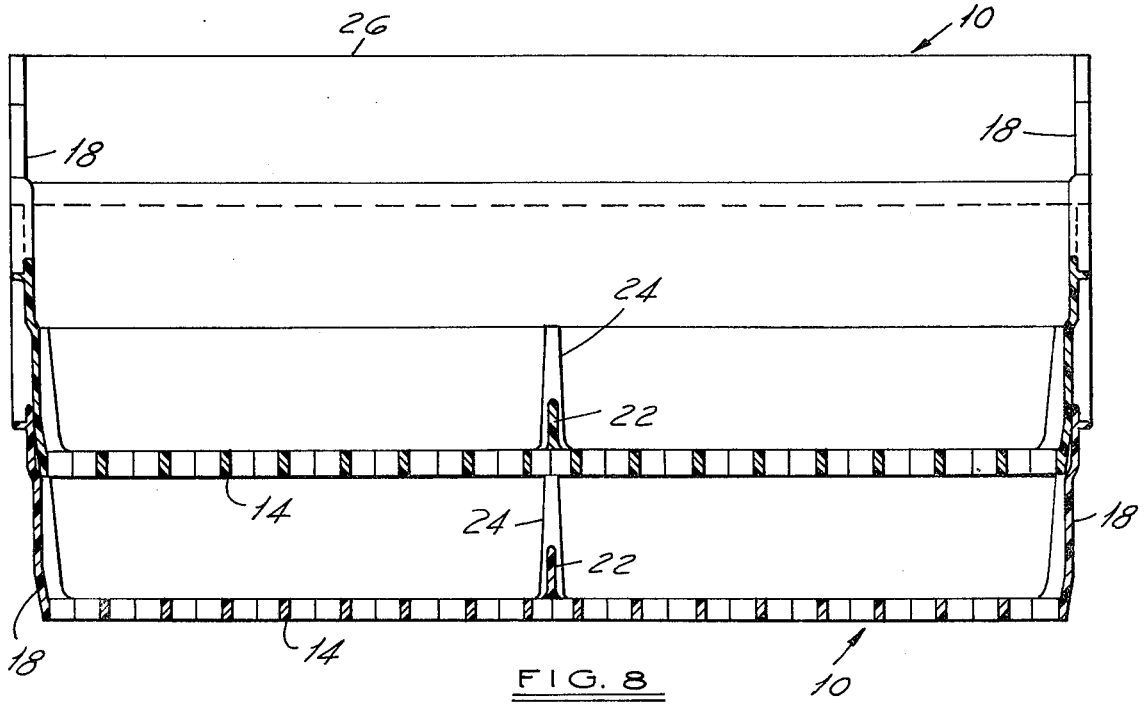
FIG. 8 is a sectional view showing two nested container parts and taken on the line 8—8 in FIG. 6.

The snap connector 32 is a recess in the form of an approximate semi-circular aperture in the side wall. The upper surface 44 of the aperture is straight and in a horizontal plane and is adapted to be engaged in full surface-to-surface relation by the shoulder 38 of a snap connector 30 when the two container parts are assembled as in FIGS. 3 and 7. The curved portion of the aperture is tapered or beveled as shown in FIGS. 6 and 7 so as to flare radially outwardly in a laterally inward direction relative to the aperture to provide a camming surface 33 extending continuously from the end 35 to the end 37 thereof shown in FIG. 6.

Each container side wall 18 also has a finger aperture 50 formed near its upper edge intermediate the ends thereof for lifting the container. The upper edge of the side wall partially surrounding the aperture 50 has an upper forwardly extending tapered projection 52 and a lower rearwardly projecting tapered recess 54. The projections and recesses 52 and 54 interfit as shown in FIG. 3 when two container parts are assembled to form the substantially closed container. Moreover, the apertures 50 in the two container parts of the closed container at one side thereof are disposed in closely spaced horizontal relation to one another so that the fingers of one hand may be simultaneously inserted therein. The container parts will not tend to separate when the container is lifted if the fingers are inserted in the apertures 50 of both parts. Even if greater lift is applied by the fingers in the aperture of the upper part, unintended separation is not likely because the interfitting projection and recess before separating would impose a lateral spreading force on the two parts that would be resisted by the snap connectors. Hence the interfitting projections and recesses resist separation of the parts when the container is raised.

Each container part also has along a diagonal portion of its upper edge 19 an upwardly extending rib 60 along the inner surface of the side wall. These ribs resist lateral shifting of an upper container part relative to a lower container part when assembled to provide the closed container shown in FIG. 3. Thus the ribs 60 of one container part extend along the inner side walls of the mating container part so that the two parts cannot shift laterally relative to one another.

When the container parts 10 are assembled to form the closed container 12, the edge 26 of the rear wall 16 of the upper part extends across and rests upon the portion of the upper edges 19 of side walls 18 of the lower part between the snap connectors 30 and the retainer or front wall 20. The heads 36 of the connector parts 30 snap into the apertures 32 with their shoulders 38 locked in full surface-to-surface contact against the surfaces 44 of the apertures.

In order to assemble two container parts to form a closed container as in FIGS. 3 and 7, one container part is turned end for end with respect to the other and superposed thereover. The reversed upper container part is lowered into assembled relation with the lower container part. During this movement, the heads 36 of the snap connector parts 30 engage the inner surfaces of the side walls 18 above the snap connector parts or apertures 32. More specifically, the tapered outer surfaces 40 of the heads 36 engage the inner surfaces of the side walls. This causes the snap connector parts to cam inwardly to permit the further downward movement of the upper container part. The material of which the container parts are made has sufficient flexibility to permit camming action of the connectors.

During the lowering of the upper container part 10 to form the container 12, the upper part should be held at a slight angle to the vertical so that the snap connectors 30, 32 at the front (or rear) snap together first, whereupon the upper container may be pivoted at the point of engagement between the edge 26 of the rear wall 16 of one container part on the edge 19 of the side walls of the other container part between the engaged snap connectors 30 and the adjacent front wall 20 to cause the engagement of the other pair of connector parts 30, 32 at the front (or rear) of the container. The projections 52 and recesses 54 interengage smoothly during this pivotal movement.

Figure 4:
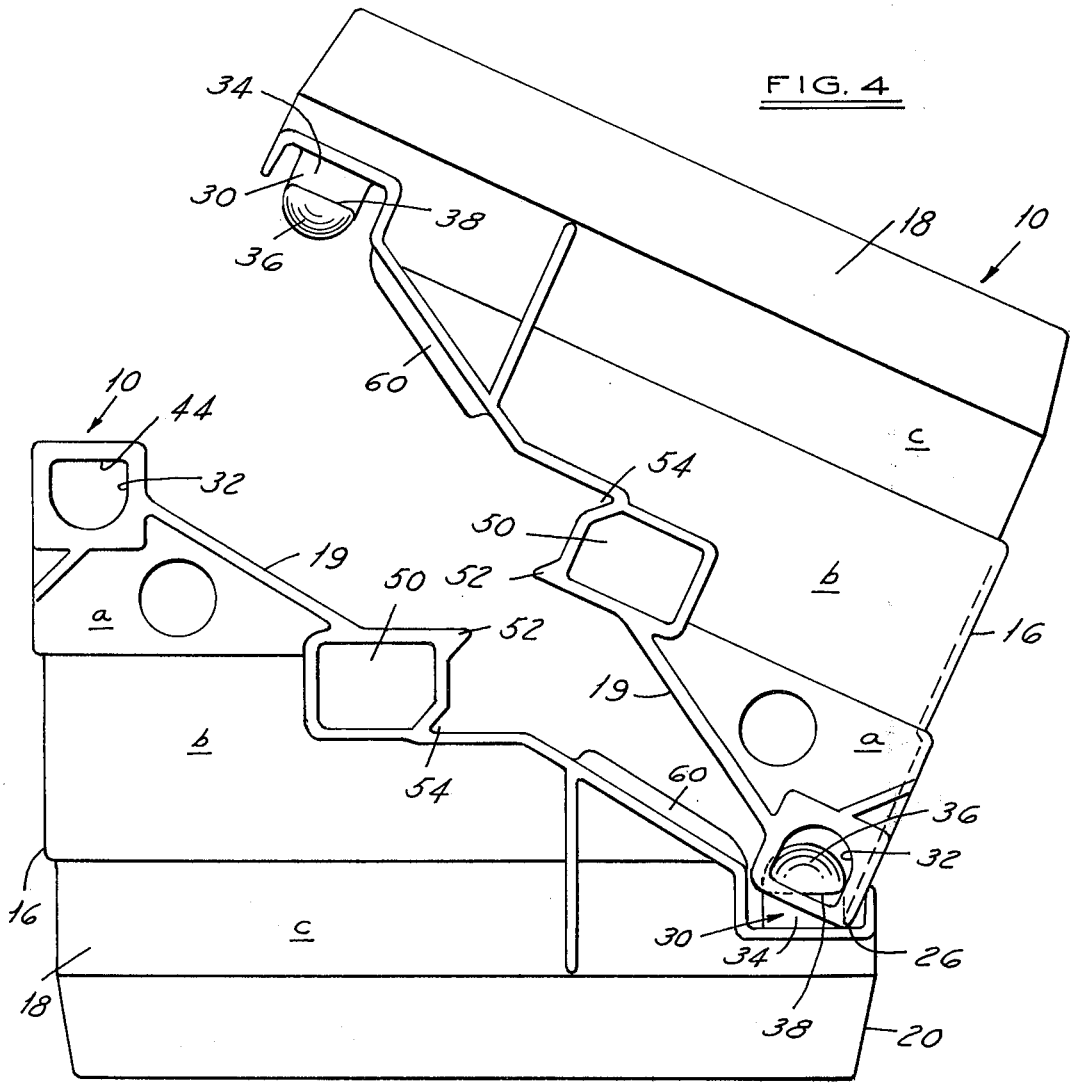
FIG. 4 is a view similar to FIG. 3, showing the container parts being disassembled.

FIG. 4 shows the container parts being pivoted clockwise relative to one another to separate the two and disassemble the container. Of course the parts can also be rotated counterclockwise if desired. First the connector parts 30, 32 at the left in FIG. 4 have been manually separated by pressing the connector parts 30 inwardly to disengage their shoulders from the apertures or connector parts 32. The subsequent pivotal action takes place on an axis determined by the edge 26 of the wall 16 of the upper container part turning on the upper edges 19 of the side walls 18 of the lower container part between the snap connectors 30 and the front wall 20 of the lower container part. This pivotal action causes the spherical surface of head 36 of the connector part 30 to engage and be cammed inwardly by the tapered camming surface 33 of the aperture 32, releasing its shoulder from engagement with the aperture. The camming action first takes place at the feathered edge of the shoulder 38 and continues until the parts are completely disengaged. Thus the connector parts 30, 32 at the right in FIG. 4 are automatically disengaged by a relative pivotal movement of the two container parts. As stated above, the separation of the two container parts in FIG. 4 could have been accomplished by first manually releasing the snap connectors 30, 32 at the right and then pivoting the upper container part connector counterclockwise with respect to the lower container part to automatically release the snap connectors at the left.

The ability to release the second set of snap connectors by rotation of the parts after manual release of the first set is of considerable advantage, because if the second set had to be manually released the first set would more than likely snap together again.

What we claim as our invention is:

1. A substantially closed container having spaced, parallel, substantially rectangular top and bottom walls, spaced parallel, substantially rectangular front and rear walls, and spaced, parallel, substantially rectangular side walls and being composed of identical separable upper and lower container parts each of one-piece construction, each part being adapted for use independently of the other for display purposes and having a substantially rectangular base, a generally upright substantially rectangular high wall at the rear of said base, a generally upright substantially rectangular low wall at the front of said base of substantially lesser height than said high wall, a pair of generally upright side walls at each side of said base, the front and top of each part being substantially open and the upper edges of the side walls thereof extending generally diagonally from an upper level at the rear of said part near the top of said high wall to a lower level at the front of said part near the top of said low wall to expose the contents of said part when used independently for display purposes, the upper edge of each side wall of each part having intermediate the ends thereof a forwardly extending projection and a rearwardly extending recess, first connecting means at the rear of each part adjacent said upper level, and cooperating second connecting means at the front of each part adjacent said lower level releasably interengageable with said first connecting means of the other part, the upper part being inverted, turned end for end and superposed over the lower part and said first and second connecting means of one part being respectively interengaged with said second and first connecting means of the other to form said substantially closed container, the bases of said upper and lower parts respectively forming the top and bottom walls of said container, the high wall of said lower part cooperating with the low wall of said upper part to form the rear wall of said container and the low wall of said lower part copperating with the high wall of said upper part to form the front wall of said container, and the side walls of said upper part respectively cooperating with the side walls of said lower part to form the side walls of said container, the projections on the side walls of each part fitting in the recesses in the side walls of the other so as to resist vertical separation of the parts when assembled together to form said container as aforesaid.

2. The container defined in claim 1, wherein said projection on each side wall of each part is disposed above the recess therein.

3. The container defined in claim 2, wherein each side wall of each part has a finger hole closely adjacent to its projection and recess, the finger holes in the side walls of the parts of said container at each side thereof being close to one another in substantially the same horizontal plane so that the fingers of one hand may be inserted therein simultaneously.

4. A substantially closed container having spaced, parallel, substantially rectangular top and bottom walls, spaced parallel, substantially rectangular front and rear walls, and spaced, parallel, substantially rectangular side walls and being composed of identical separable upper and lower container parts each of one-piece construction, each part being adapted for use independently of the other for display purposes and having a substantially rectangular base, a generally upright substantially rectangular high wall at the rear of said base, a generally upright substantially rectangular low wall at the front of said base of substantially lesser height than said high wall, a pair of generally upright side walls at each side of said base, the front and top of each part being substantially open and the upper edges of the side walls thereof extending generally diagonally from an upper level at the rear of said part near the top of said high wall to a lower level at the front of said part near the top of said low wall to expose the contents of said part when used independently for display purposes, each side wall of each part having a finger hole adjacent its upper edge intermediate the ends thereof, first connecting means at the rear of each part adjacent said upper level, and cooperating second connecting means at the front of each part adjacent said lower level releasably interengageable with said first connecting means of the other part, the upper part being inverted, turned end for end and superposed over the lower part and said first and second connecting means of one part being respectively interengaged with said second and first connecting means of the other to form said substantially closed container, the bases of said upper and lower parts respectively forming the top and bottom walls of said container, the high wall of said lower part cooperating with the low wall of said upper part to form the rear wall of said container and the low wall of said lower part cooperating with the high wall of said upper part to form the front wall of said container, and the side walls of said upper part respectively cooperating with the side walls of said lower part to form the side walls of said container, the finger holes in the side walls of the parts of the container at each side thereof being close to one another in substantially the same horizontal plane so that the fingers of one hand may be inserted therein simultaneously.

5. A substantially closed container having spaced, parallel, substantially rectangular top and bottom walls, spaced parallel, substantially rectangular front and rear walls, and spaced, parallel, substantially rectangular side walls and being composed of identical separable upper and lower container parts each of one-piece construction, each part being adapted for use independently of the other for display purposes and having a substantially rectangular base, a generally upright substantially rectangular high wall at the rear of said base, a generally upright substantially rectangular low wall at the front of said base of substantially lesser height than said high wall, a pair of generally upright side walls at each side of said base, the front and top of each part being substantially open and the upper edges of the side walls thereof extending generally diagonally from an upper level at the rear of said part near the top of said high wall to a lower level at the front of said part near the top of said low wall to expose the contents of said part when used for display purposes, first connecting means at the rear of each part adjacent said upper level, and cooperating second connecting means at the front of each part adjacent said lower level releasably interengageable with said first connecting means of the other part, the upper part being inverted, turned end for end and superposed over the lower part and said first and second connecting means of one part being respectively interengaged with said second and first connecting means of the other to form said substantially closed container, the bases of said upper and lower parts respectively forming the top and bottom walls of said container, the high wall of said lower part cooperating with the low wall of said upper part to form the rear wall of said container and the low wall of said lower part cooperating with the high wall of said upper part to form the front wall of said container, and the side walls of said upper part respectively cooperating with the side walls of said lower part to form the side walls of said container, camming means operative to effect disengagement of said connecting means at the front of one container part and the rear of the other in response to relative pivotal movement of said parts, said parts having cooperating means adjacent the connecting means to be disengaged by camming for establishing the axis about which said parts will pivot relative to one another as aforesaid.

6. The container defined in claim 5, wherein said cooperating means comprises the upper edge of the high wall of one part pivoting on the portions of the upper edges of the side walls of the other part between the low wall of said other part and the adjacent connecting means thereof.

7. The container defined in claim 5, wherein each first connecting means comprises a member having an enlarged head and each second connecting means comprises a socket having a recess adapted to receive said head.

8. The container defined in claim 7, wherein said head and recess having cooperative camming surfaces adapted to cam away and disengage said head from said recess in response to the aforesaid relative pivotal movement.

9. The container defined in claim 8, wherein said cooperative camming surfaces includes a beveled surface portion of said recess.

10. The container defined in claim 8, wherein said cooperative camming means includes a part-spherical surface portion of said head.

11. The container defined in claim 8, wherein said cooperative camming surfaces includes a beveled surface portion of said recess and a part-spherical surface portion of said head, and said cooperating means comprises the upper edge of the high wall of one part pivoting on the portions of the upper edges of the side walls of the other part between the lower wall of said other part and the adjacent connecting means thereof.

* * * * *